US011136712B2

(12) United States Patent
Erb et al.

(10) Patent No.: US 11,136,712 B2
(45) Date of Patent: Oct. 5, 2021

(54) AQUEOUS COMPOSITION FOR IMPROVING ABRASION RESISTANCE

(71) Applicant: CHT GERMANY GMBH, Tübingen (DE)

(72) Inventors: Alfons Erb, Motten (DE); André Weiss, Hochkirch (DE); Matthias Bauer, Ehningen (DE)

(73) Assignee: CHT Germany GMBH, Tubingen (DE)

( * ) Notice: Subject to any disclaimer, the term of this patent is extended or adjusted under 35 U.S.C. 154(b) by 152 days.

(21) Appl. No.: 16/481,929

(22) PCT Filed: Feb. 14, 2018

(86) PCT No.: PCT/EP2018/053710
§ 371 (c)(1),
(2) Date: Jul. 30, 2019

(87) PCT Pub. No.: WO2018/153760
PCT Pub. Date: Aug. 30, 2018

(65) Prior Publication Data

US 2020/0056328 A1 Feb. 20, 2020

(30) Foreign Application Priority Data

Feb. 22, 2017 (DE) ..... 102017202827.0

(51) Int. Cl.

| | |
|---|---|
| ***D06M 15/564*** | (2006.01) |
| ***D06M 13/02*** | (2006.01) |
| ***D06M 13/224*** | (2006.01) |
| ***D06M 15/263*** | (2006.01) |
| ***D06M 15/643*** | (2006.01) |

(52) U.S. Cl.
CPC ..... *D06M 15/564* (2013.01); *D06M 13/02* (2013.01); *D06M 13/224* (2013.01); *D06M 15/263* (2013.01); *D06M 15/643* (2013.01); *D06M 2200/35* (2013.01)

(58) Field of Classification Search
CPC .. D06M 13/02; D06M 13/224; D06M 15/263; D06M 15/564; D06M 15/643; D06M 2200/35
See application file for complete search history.

(56) References Cited

U.S. PATENT DOCUMENTS

| | | | | |
|---|---|---|---|---|
| 2,971,934 | A * | 2/1961 | Brown | C08L 2666/04 524/517 |
| 4,767,646 | A | 8/1988 | Cordova et al. | |
| 4,874,663 | A | 10/1989 | Marshall | |
| 2006/0212992 | A1 * | 9/2006 | Nile | A61L 31/049 2/168 |
| 2008/0241532 | A1 | 10/2008 | Wattenhofer et al. | |
| 2010/0035493 | A1 | 2/2010 | Oki et al. | |

FOREIGN PATENT DOCUMENTS

| | | | | |
|---|---|---|---|---|
| CN | 1918231 | A | 2/2007 | |
| DE | 3435618 | A1 | 4/1986 | |
| DE | 103 41 587 | A1 | 7/2004 | |
| DE | 10 2007 019 179 | A1 | 10/2008 | |
| DE | 10 2012 216 871 | A1 | 12/2013 | |
| EP | 1 424 433 | A2 | 6/2004 | |
| EP | 2 233 633 | A1 | 9/2010 | |
| WO | 94/07932 | A1 | 4/1994 | |
| WO | WO-9407932 | A1 * | 4/1994 | C08G 18/10 |
| WO | 03/078726 | A1 | 9/2003 | |

OTHER PUBLICATIONS

AQUACER 535 Technical Data Sheet (Year: 2020).*
LUBA-Print CA 30 Technical Data Sheet (Year: 2015).*
Josh Staas, Improving Abrasion Resistance, Coim USA Inc., www.coimgroup.com.
International Search Report for International Application No. PCT/EP2018/053710 dated Apr. 30, 2018.

* cited by examiner

*Primary Examiner* — Anthony J Green
(74) *Attorney, Agent, or Firm* — Nexsen Pruet, PLLC; Seth L. Hudson

(57) ABSTRACT

The invention relates to a formulation which is used on textile surfaces, tissues, non-crimp fabrics, knitted fabrics, fibers, non-woven fabrics and weft knitted fabrics and which demonstrates an improved resistance to abrasion. The invention also relates to a process of preparing a formulation for improving abrasion resistance of textiles and the process of treating textiles, non-woven fabrics and leather articles for improving abrasion resistance.

6 Claims, No Drawings

AQUEOUS COMPOSITION FOR IMPROVING ABRASION RESISTANCE

FIELD OF THE INVENTION

The invention describes an aqueous formulation based on waxes and polymer dispersions, which is applied to textile fabrics, woven fabrics, scrims, knitted fabrics, fibers, nonwoven and weft-knitted fabrics as well as leather, in order to protect the material, to reduce the mass loss under stress, and thus to improve scuff resistance or abrasion resistance.

BACKGROUND OF THE INVENTION

High demands are put on textiles today in many fields of application. One of these requirements relates to abrasion and scuff resistance. For example, very high abrasion resistance requirements are put on textiles for interior trim in the automotive sector and there especially in the areas that come into contact with the passenger. In vehicles of the middle upper class and upper class, textiles having a rather complicated production, such as taffeta, are employed to meet the applicable standards. In lower price segments, dilour nonwovens are often used. These dilour nonwovens are needle-punched nonwovens produced in the classical way, and in a subsequent step, they are additionally solidified even more on a so-called dilour plant of the company Dilo (69405 Eberbach/Germany). Therefore, the term dilourization is also used to describe a mechanical pile fiber formation as a follow-up process to needle-punching, with the aim to increase the value of the nonwoven. Needle-punched nonwovens are generally mono- or multi-layer textile sheets consisting of a bonded fibrous nonwoven. In the nonwoven production, the synthetic fibers polyester, polyamide and polypropylene are mainly employed, to a limited extent with additions of cellulose or animal hair. Needle-punched nonwovens are produced with a needling machine, which bonds a fibrous wear layer and a fibrous cushion layer together by means of needles. Thereafter, the needle-punched nonwoven is bonded mechanically and chemically or thermally. Needle-punched nonwovens are very durable and insensitive to dirt because of the fiber mixture. The quality of the wear layer is determined by the needle punch density/$m^2$. It is between 1 and 4 million per square meter, the closer the better.

Nevertheless, because of their design, abrasion resistance for demanding applications, which is, however, required in the technical delivery conditions, especially in the automotive sector, cannot be achieved with such nonwovens.

For the determination of abrasion resistance, the so-called Taber test in accordance with DIN EN ISO 5470 is often used as a test method in the automotive sector. Therefore, this test is also mentioned in numerous publications with automotive-related topics. By way of example, the following publications may be mentioned: "Study of the abrasion resistance in the upholstery of automobile seats" by I. Jerkovic, J. Pallares and X. Capdevilla in AUTEX Research Journal Vol. 10, No. 1, March 2010, pages 14-20), and "Investigation on abrasion resistance of the automotive seats fabrics" by F. Goksel et al. in Proceedings of the Aachen-Dresden International Textile Conference (2008), Volume 2nd, GOKS/1-GOKS/6 Publisher: DWI at RWTH Aachen e.V., Aachen, Germany.

In the literature, approaches are known to improve the wear resistance by changing the textile construction. Thus, DE 10 2006 058 257 A1 describes composite components, and a process for producing composite components, especially for the automotive industry. WO 03/032701 A1 describes a special yarn construction from a plurality of individual yarns. Both documents describe quite expensive and very high-price solutions in comparison to a subsequent application of an aqueous formulation according to a standard method in the textile industry.

DE 10 2012 216 871 A1 describes a material for a carpet yarn having improved abrasion resistance which is used in vehicles in the form of tufted carpets. This publication describes a specific material mixture of the yarns employed of PET (polyethylene terephthalate) and PTT (polytrimethylene terephthalate), by which the abrasion resistance can be improved. A similar approach is used in EP 0 784 107 A2. In this specification, melt-spun monofilaments of polyamide, polyester or propylene are described as fiber-forming polymers with improved abrasion resistance. Both documents describe very complex and high-priced solutions and do not address the possibility of a subsequent coating or finishing.

DE 10 2007 019 179 A1 follows the approach of applying a wear-resistant layer for improving abrasion resistance. However, this document describes only the use on hard surfaces, such as furniture, flooring and ceramics, and cannot be transferred to textiles, as the textile nature of the substrate is lost completely by corresponding applications.

A similar approach is described in DE 103 41 587 A1. The improvement in abrasion resistance in this publication is obtained by applying a three-dimensional pattern by a printing method. By applying this dimensional pattern, the textile character, however, is also lost for the most part. Moreover, this method is completely unsuitable for some types of textiles, such as for dilour nonwovens.

In the publication by Josh Staas (internet inquiry of Feb. 8, 2017, http://www.pmahome.org/files/1713/9830/9223/343_Improving_Abrasion_Resistance.pdf), two polyurethanes, a TDI ester and a TDI ether as pure substances are examined for abrasion resistance according to Taber alone and in combination with various chemical product classes. However, the abrasion resistance described in this publication refer only to the pure or additive-containing polyurethanes themselves and not to a reduction in mass loss under stress of a textile material. Therefore, the experiments in this publication provide serious and sometimes even contradictory results and are therefore not applicable to textiles. Thus, substances such as pure polyurethanes, coarse-grained, high-melting polyethylenes, oily silicones or titanium carbides and combinations thereof show no or only marginal improvements in abrasion behavior of textiles. In addition, the mentioned compounds are not in aqueous form and therefore cannot be applied by processes usual in the textile industry, such as padding, spraying application, or foam-paste application.

The combination of wax and silicone oil emulsion to improve the friction and sliding properties of yarns is known to the skilled person from WO 03/078726 A1 and the documents cited therein.

BRIEF SUMMARY OF THE INVENTION

With such combinations, however, can also be achieved on fabrics such as nonwovens dilour no significant protection of materials.

With such combinations, however, a significant protection of materials cannot be achieved on fabrics such as dilour nonwovens.

Therefore, the object of the invention was to provide a product that significantly improves the abrasion resistance of textiles, above all of dilour nonwovens as employed in the automotive field. Further, the product should be in aqueous form and should be applicable by processes conventional in the textile industry, such as padding, spray application, or foam paste application. In addition, the product should have no negative effects on other technological properties of the substrate, such as color, graying, soiling and feel. It is also required that the necessary temporary superficial protection function, which is mandatory for protection during transport and thus for completing the manufacturing process, is not adversely affected.

DESCRIPTION OF THE INVENTION

It is to be understood that the ranges and limits mentioned herein include all ranges located within the prescribed limits (i.e., subranges). For instance, a range from 20° to 120° C. also includes ranges from 20° to 100° C., 20° to 0° C., 33° to 113° C. and 35.3° to 99.6° C. Further, a a range of from 20 to 95% also includes ranges from 20 to 80%, 30 to 95%, 33 to 93%, and 33.3 to 90.3% as examples.

The above object is achieved by a formulation for improving the abrasion resistance of textile materials that includes the following components:

a) 10 to 90% by weight of a wax-containing aqueous dispersion, b) 90 to 10% by weight of an aqueous polymer dispersion wherein the water content of the dispersions is respectively from 20 to 95%, and the waxes have melting points of <120° C.

A process for improving the abrasion resistance of textile materials includes providing a dispersion that includes, a) 10 to 90% by weight of a wax-containing aqueous dispersion, b) 90 to 10% by weight of an aqueous polymer dispersion wherein the water content of the dispersions is respectively from 20 to 95%, and the waxes of said wax-containing aqueous dispersions have melting points of between 20-120° C., wherein said aqueous polymer dispersion is a polyurethane dispersion or polyacrylate dispersion; and applying the dispersion to a textile material.

Surprisingly, it has been found that the combinations of aqueous wax dispersions, in which the bulk of the wax component have melting points of <120° C., preferably from 20° to 120° C., more preferably from 20° to 100°, and most preferably from 20° to 80° with aqueous polymer dispersions show a significantly greater improvement in abrasion resistance than is observed with the individual components.

All previous attempts to solve the problem of low abrasion resistance of textiles, especially dilour nonwovens, using finishing or coating agents so far have not provided a satisfactory result. Therefore, with untreated dilour nonwovens, the requirements of car manufacturers, even with high-quality fiber blends, cannot be met currently. Therefore, finishing is absolutely necessary in order to be able to deliver dilour nonwovens in accordance with specifications.

By the finishing with a mixture according to the invention consisting of aqueous wax dispersions in combination with the aqueous polymer dispersion, it is now possible to improve the abrasion resistance so that a level is reached that previously could only be reached with much more expensive materials (taffeta fabrics). With formulations according to the invention, it thereby becomes possible that dilour nonwovens with a subsequent application by a standard method in the textile industry can be employed also in high-quality automotive segments, such as the "upper-middle class."

The wax dispersions consist of waxes based on natural, semi-synthetic, synthetic waxes. Natural waxes can be distinguished into mineral, vegetable and animal waxes, all of which can be employed according to the invention. Vegetable waxes include, for example, carnauba or Japan waxes, mineral waxes include, for example, ceresin or montan waxes (raw montan waxes, acid waxes, ester waxes, partially saponified ester waxes, emulsifier-containing ester waxes, fully saponified montan waxes). Beeswax, lanolin may be mentioned as examples of animal waxes. Synthetic waxes are those based on polyalkylene (polyethylene, polypropylene, polyolefin waxes), silicone waxes, polyol ether esters, Fischer-Tropsch waxes, oxidized PE and HDPE waxes, paraffins, amide waxes, such as ethylenebis(stearoyldiamide). Semisynthetic waxes are chemically modified waxes from native sources, such as hydrogenated jojoba and Sasol waxes. The waxes can consist of a combination of the waxes set forth above.

The polymer dispersions include polymers and/or copolymers as a single component or in mixtures, selected from the groups of polyacrylates, polyurethanes, polybutadienes, polystyrenes, polyethylene terephthalates, polyesters, and silicone polymers.

Both from the aforementioned waxes and from the polymers, aqueous dispersions with water contents of 20-95% by weight are prepared according to the respective state of the art and by methods known to the skilled person. It is advantageous to provide formulations according to the invention with the lowest possible water contents in order to save transport costs and to expend as little energy as possible for drying. In addition, water-based systems offer the advantage of having very low VOC values and to be more ecologically sustainable as compared to solvent-based systems. VOC is an abbreviation for volatile organic compounds and is a collective term for organic, i.e., carbon-containing, substances that are very volatile and are present as a gas already at low temperatures (e.g., room temperature).

The aqueous formulations of the invention on the basis of a mixture of wax and polymer dispersion are applied to the textile substrates in textile-technical processes, forced applications, especially coating, such as in an application bath, finishing by padding, spray method, foam-paste application, monofilament application and/or dyeing, but also by extraction methods. In suitable methods, such as padding, foam or paste application and spray method, a backside latex application for a stronger reinforcement of the material can be affected in the same step.

Textile materials may include all textile sheets, fabrics, scrims, knitted fabrics, fibers, nonwovens and weft-knitted fabrics as well as leather can be treated as substrates with the dispersion formulation according to the invention to improve their scuff resistance and abrasion resistance. Preferably, the textile materials may be dilour nonwovens and textiles in the automotive field can be treated with the formulation by applying the dispersion formulation to these textile materials for improving abrasion resistance.

The dispersion may include additives selected from the groups consisting of cross-linking agents, defoaming agents, processing aids, plasticizers, or other polymer dispersions.

EXAMPLES

Raw Materials Employed

Beiphob zeroF=wax dispersion based on waxes/silicone waxes with melting points of 65-68° C. and 30-32° C., available from CHT R. Beitlich GmbH, Tübingen, Germany.

Polyavin PEN=polyethylene dispersion based on an HD polyethylene having a melting point of 135-137° C., available from CHT R. Beitlich GmbH, Tübingen, Germany.

Intermediate product NLDPE=polyethylene dispersion based on polyethylene with melting points of 104-108° C. and 90-92° C., available from CHT R. Beitlich GmbH, Tübingen, Germany.

Tubicoat Primer LE=cationic, hydrophobic polyurethane dispersion giving a very soft film, available from CHT R. Beitlich GmbH, Tübingen, Germany.

Arristan CPU=cationic, hydrophilic polyurethane dispersion giving a soft film, available from CHT R. Beitlich GmbH, Tübingen, Germany.

Erlapon SOL=emulsion based on a polydimethylsiloxane, available from CHT R. Beitlich GmbH, Tübingen, Germany.

Lustraffin SA 88=emulsion on the basis of a paraffin with a melting point of 60-62° C. and wax components having a melting point of 102-110° C., available from CHT R. Beitlich GmbH, Tübingen, Germany.

Tubicoat A 19=acrylate-based plastic dispersion, giving a very soft film, available from CHT R. Beitlich GmbH, Tübingen, Germany.

Tubicoat A 41=acrylate-based plastic dispersion, giving a rigid film, available from CHT R. Beitlich GmbH, Tübingen, Germany.

Tubicoat ZWE=emulsion on the basis of a paraffin having a melting point of 60° C., available from CHT R. Beitlich=GmbH, Tübingen, Germany.

Tubicoat AOS=foaming agent for foam finishing techniques, available from CHT R. Beitlich GmbH, Tübingen, Germany.

To improve comparability, all formulations were adjusted to a solids content of 20% by weight by the addition of water.

The product was applied in the form of an unstable foam by a foam-padding method. The fabric was passed vertically from top to bottom through a foam-padding machine. As a foaming agent, respectively, 7 g/l Tubicoat AOS was added to the liquor, and the foam weight per liter was adjusted to 40 g/l.

The experiments were performed on a dilour nonwoven in accordance with TL 52442. This is a needle-punched nonwoven made from spun-dyed polyester fibers, with 11 dtex, which has been thermo-mechanically fixed.

The abrasion resistance of the finished fabrics was tested with a Taber Rotary Abraser 5135 available from Taber Industries, North Tonawanda, United States, according to DIN provision DIN EN ISO 5470.

Experimental Series 1: Concentration Series (According to the Invention)

TABLE 1a

| | Raw fabric [g/l] | 1 [g/l] | 2 [g/l] | 3 [g/l] | 4 [g/l] | 5 [g/l] | 6 [g/l] |
|---|---|---|---|---|---|---|---|
| Beiphob zeroF | 0 | 10 | 25 | 50 | 100 | 150 | 250 |
| Tubicoat Primer LE | 0 | 3.2 | 8 | 16 | 32 | 48 | 80 |
| Water | 0 | 6.8 | 17 | 34 | 68 | 102 | 170 |

Solids content of the formulations=20% by weight

TABLE 1b

| Sample designation | Raw fabric | | Formulation 1 | | Formulation 2 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 6094.9 | 5843.7 | 6318.9 | 5872.9 | 5853.7 | 5661.8 |
| Weight after test in mg | 5885.3 | 5618.8 | 6141.7 | 5616.8 | 5648.8 | 5437.9 |
| Weight loss in mg | 209.60 | 224.90 | 177.20 | 256.10 | 204.90 | 223.90 |
| Weight loss in % | 3.44 | 3.85 | 2.80 | 4.36 | 3.50 | 3.95 |
| Average weight loss in % | 3.64 | | 3.58 | | 3.73 | |

TABLE 1c

| Sample designation | Formulation 3 | | Formulation 4 | | Formulation 5 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 5877 | 5869.3 | 6153.1 | 6181.6 | 6319.9 | 6281.5 |
| Weight after test in mg | 5733.4 | 5690.4 | 6077.9 | 6115.1 | 6248.1 | 6234.4 |
| Weight loss in mg | 143.6 | 178.9 | 75.2 | 66.5 | 71.8 | 47.1 |
| Weight loss in % | 2.44 | 3.05 | 1.22 | 1.08 | 1.14 | 0.75 |
| Average weight loss in % | 2.75 | | 1.15 | | 0.95 | |

TABLE 1d

| Sample designation | Formulation 6 | |
|---|---|---|
| Cycles | 1000 | 1000 |
| Abrasion wheels | H18 | H18 |
| Additional weight | 1000 g/ wheel | 1000 g/ wheel |
| Weight before test in mg | 6531.6 | 6646.2 |
| Weight after test in mg | 6492 | 6618.4 |
| Weight loss in mg | 39.6 | 27.8 |
| Weight loss in % | 0.61 | 0.42 |
| Average weight loss in % | 0.51 | |

On the basis of Tables 1a-1d, it can be seen that the average percentage weight loss in the Taber test is within a range of 1% or below from formulation 4, which corresponds to a quantity employed of 200 g/l with its total solids concentration of 20%. As compared to unfinished fabrics, this means an improvement of 65% or more.

Experimental Series 2: Variation of the Ratio of Wax Dispersion to Polyurethane Dispersion TABLE 2a

| | 7 [g/l] | 8 [g/l] | 9 [g/l] | 10 [g/l] | 11 [g/l] | 12 [g/l] | 13 [g/l] | 14 [g/l] |
|---|---|---|---|---|---|---|---|---|
| Beiphob zeroF | 132 | 112 | 100 | 92 | 72 | 52 | 32 | 0 |
| Tubicoat Primer LE | 0 | 20 | 32 | 40 | 60 | 80 | 100 | 132 |
| Water | 68 | 68 | 68 | 68 | 68 | 68 | 68 | 68 |
| | 200 | 200 | 200 | 200 | 200 | 200 | 200 | 200 |

Solids content of the formulations=20% by weight

TABLE 2b

| Sample designation | Formulation 7 | | Formulation 8 | | Formulation 9 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 5958.4 | 6251.1 | 6284 | 6560.9 | 6029.5 | 6035.1 |
| Weight after test in mg | 5849.8 | 6127.9 | 6205.7 | 6467 | 5974.8 | 5965.6 |
| Weight loss in mg | 108.60 | 123.20 | 78.30 | 93.90 | 54.70 | 69.50 |
| Weight loss in % | 1.82 | 1.97 | 1.25 | 1.43 | 0.91 | 1.15 |
| Average weight loss in % | 1.90 | | 1.34 | | 1.03 | |

TABLE 2c

| Sample designation | Formulation 10 | | Formulation 11 | | Formulation 12 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 5917.1 | 6009.4 | 5917.1 | 6009.4 | 6421.6 | 5933.9 |
| Weight after test in mg | 5881.3 | 5982.8 | 5881.3 | 5982.8 | 6389.8 | 5895.1 |
| Weight loss in mg | 35.80 | 26.60 | 35.80 | 26.60 | 31.80 | 38.80 |
| Weight loss in % | 0.61 | 0.44 | 0.61 | 0.44 | 0.50 | 0.65 |
| Average weight loss in % | 0.52 | | 0.52 | | 0.57 | |

TABLE 2d

| Sample designation | Formulation 13 | | Formulation 14 | |
|---|---|---|---|---|
| Cycles | 1000 | 1000 | 1000 | 1000 |
| Abrasion wheels | H18 | H18 | H18 | H18 |
| Additional weight | 1000 g/ wheel | 1000 g/ wheel | 1000 g/ wheel | 1000 g/ wheel |
| Weight before test in mg | 5802.7 | 6226.4 | 6114.9 | 6041 |
| Weight after test in mg | 5783.5 | 6176.4 | 6000.9 | 5893.5 |
| Weight loss in mg | 19.20 | 50.00 | 114.00 | 147.50 |
| Weight loss in % | 0.33 | 0.80 | 1.86 | 2.44 |
| Average weight loss in % | 0.57 | | 2.15 | |

On the basis of Tables 2a-2d, it is apparent from the formulations 7 and 14, which are not according to the invention, that improvements in a mixture can be achieved neither by the sole use of the wax dispersion nor by the sole use of the polymer dispersion. It is also apparent that significant improvements in abrasion can be achieved only through the combination according to the invention of the two individual components. The best results are achieved with the formulations 9-13, representing the range of the mixing ratio of wax/polyurethane dispersion from about 3:1 to 1:3.

Experimental Series 3: Examination of Further Additives, Such as Polyethylene Dispersions, and of an Emulsion Based on Polydimethylsiloxane In experimental series 3, the influence of the melting point of the waxes as well as that of emulsions on PDMS is examined (formulations according to the invention: 16, 17, 18; formulations not according to the invention: 15, 19, 20).

TABLE 3a

| | 15 [g/l] | 16 [g/l] | 17 [g/l] | 18 [g/l] | 19 [g/l] | 20 [g/l] |
|---|---|---|---|---|---|---|
| Beiphob zeroF | | | | | 40 | 60 |
| Polyavin PEN | 100 | | | | | |
| Intermediate product NLDPE | | 100 | | | | |
| Lustraffin SA 88 | | | 60 | | | |
| Tubicoat ZWE | | | | 60 | | |
| Erlapon SOL | | | | | 15 | 30 |
| Tubicoat Primer LE | 32 | 32 | 32 | 32 | 32 | 32 |
| Water | 34 | 34 | 54 | 54 | 36.5 | 78 |
| | 200 | 200 | 200 | 200 | 200 | 200 |

Solids content of the formulations=20% by weight

TABLE 3b

| Sample designation | Formulation 15 | | Formulation 16 | | Formulation 17 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 6151.1 | 6107.7 | 5926.1 | 6318.3 | 5976.9 | 5999.5 |
| Weight after test in mg | 5994.9 | 5895.8 | 5773.6 | 6271.4 | 5961.7 | 5973.1 |
| Weight loss in mg | 156.20 | 211.90 | 152.50 | 46.90 | 15.20 | 26.40 |
| Weight loss in % | 2.54 | 3.47 | 2.57 | 0.74 | 0.25 | 0.44 |
| Average weight loss in % | 3.01 | | 1.66 | | 0.35 | |

TABLE 3c

| Sample designation | Formulation 18 | | Formulation 19 | | Formulation 20 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 5957.1 | 5510.5 | 5746.5 | 6085.9 | 6210.4 | 6028.9 |
| Weight after test in mg | 5923 | 5487.7 | 5652.5 | 5878.7 | 6039.2 | 5843.3 |
| Weight loss in mg | 34.10 | 22.80 | 94.00 | 207.20 | 171.20 | 185.60 |
| Weight loss in % | 0.57 | 0.41 | 1.64 | 3.40 | 2.76 | 3.08 |
| Average weight loss in % | 0.49 | | 2.52 | | 2.92 | |

Based on the Tables 3a-3c, it can be seen that the formulations 15, 19 and 20, which are not according to the invention, show virtually no or only insignificant abrasion improvements as compared to the raw fabric. This leads to the conclusion that neither polyethylene dispersions based on HD waxes nor the addition of PDMDS emulsions exhibit an effect in terms of abrasion improvement. Although, with formulation 16, based on a wax dispersion with LD polyethylenes, the average abrasion is improved, this is only by about 45% as compared to the raw fabric. Minimal weight losses by abrasion in a Taber test is obtained with formulations 17 and 18. Both formulations contain waxes or paraffins with melting points below 80° C.

Experimental Series 4: Examination of Further Product Classes

In the experimental series, the effects of two acrylate dispersions and that of a hydrophilic cationic polyurethane dispersion are examined (according to the invention).

TABLE 4a

| | 21 [g/l] | 22 [g/l] | 23 [g/l] |
|---|---|---|---|
| Beiphob zeroF | 100 | 100 | 100 |
| Tubicoat A 17 | 16 | | |
| TUBICOAT A 41 | | 19.2 | |
| Arristan CPU | | | 32 |
| Water | 84 | 80.8 | 68 |
| | 100 | 100 | 100 |

Solids content of the formulations=20% by weight

TABLE 4b

| Sample designation | Formulation 21 | | Formulation 22 | | Formulation 23 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 6070.7 | 6392.7 | 5447.8 | 6028.4 | 5553.1 | 5980.6 |
| Weight after test in mg | 6002.4 | 6368.3 | 5379.7 | 5950.2 | 5482.3 | 5948.8 |
| Weight loss in mg | 68.30 | 24.40 | 68.10 | 78.20 | 70.80 | 31.80 |
| Weight loss in % | 1.13 | 0.38 | 1.25 | 1.30 | 1.27 | 0.53 |
| Average weight loss in % | 0.75 | | 1.27 | | 0.90 | |

Based on the Tables 4a-4b, it can be seen that the formulations 21-23 based on wax dispersions in combination with hydrophilic polyurethane dispersions as well as two acrylate dispersions selected by way of example provide a significant improvement in abrasion resistance according to Taber. Here, the dispersions that form rather soft films on drying, such as Arristan CPU and Tubicoat A 17, show better results than those forming rather rigid films, such as Tubicoat A 41. Generally, however, the selection of the wax dispersion seems to show a greater influence than that of the polymer dispersion.

In order to illustrate the effect of the synergistic mixture of a wax dispersion with a polymer dispersion once again clearly, the products previously used in combination are shown in a way not according to the invention as individual components in Tables 5a-5d.

Experimental Series 5: Use of the Products as Individual Components (not According to the Invention)

TABLE 5a

| | 24 [g/l] | 25 [g/l] | 26 [g/l] | 27 [g/l] | 28 [g/l] | 29 [g/l] | 30 [g/l] | 31 [g/l] |
|---|---|---|---|---|---|---|---|---|
| Polyavin PEN (HD) | 132 | | | | | | | |
| Intermediate product | | 132 | | | | | | |

TABLE 5a-continued

| | 24 [g/l] | 25 [g/l] | 26 [g/l] | 27 [g/l] | 28 [g/l] | 29 [g/l] | 30 [g/l] | 31 [g/l] |
|---|---|---|---|---|---|---|---|---|
| NLDPE (LD) | | | | | | | | |
| Lustraffin SA 88 | | | 80 | | | | | |
| Tubicoat ZWE | | | | 80 | | | | |
| Erlapon SOL | | | | | 100 | | | |
| TUBICOAT A 17 | | | | | | 66 | | |
| TUBICOAT A 41 | | | | | | | 79.2 | |
| Arristan CPU | | | | | | | | 132 |
| Water | 68 | 68 | 120 | 12 | 100 | 134 | 120.8 | 68 |
| | 200 | 200 | 200 | 200 | 200 | 200 | 200 | 200 |

Solids content of the formulations=20% by weight

TABLE 5b

| Sample designation | Formulation 24 | Formulation 24 | Formulation 25 | Formulation 25 | Formulation 26 | Formulation 26 |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 5844.4 | 5994 | 6147.3 | 6066 | 6163.9 | 6337.7 |
| Weight after test in mg | 5679.6 | 5768.3 | 6020.7 | 5950.2 | 6020.8 | 6238.6 |
| Weight loss in mg | 164.80 | 225.70 | 126.60 | 115.80 | 143.10 | 99.10 |
| Weight loss in % | 2.82 | 3.77 | 2.06 | 1.91 | 2.32 | 1.56 |
| Average weight loss in % | 3.29 | | 1.98 | | 1.94 | |

TABLE 5c

| Sample designation | Formulation 27 | | Formulation 28 | | Formulation 29 | |
|---|---|---|---|---|---|---|
| Cycles | 1000 | 1000 | 1000 | 1000 | 1000 | 1000 |
| Abrasion wheels | H18 | H18 | H18 | H18 | H18 | H18 |
| Additional weight | 1000 g/ wheel | 1000 g/ wheel | 1000 g/ wheel | 1000 g/ wheel | 1000 g/ wheel | 1000 g/ wheel |
| Weight before test in mg | 6222.8 | 6100.5 | 5882.9 | 5672.9 | 6530.7 | 6208.8 |
| Weight after test in mg | 6099.7 | 5992.6 | 5753 | 5501.8 | 6355.8 | 5966.5 |
| Weight loss in mg | 123.10 | 107.90 | 129.90 | 171.10 | 174.90 | 242.30 |
| Weight loss in % | 1.98 | 1.77 | 2.21 | 3.02 | 2.68 | 3.90 |
| Average weight loss in % | 1.87 | | 2.63 | | 3.29 | |

TABLE 5d

| Sample designation | Formulation 30 | | Formulation 31 | |
|---|---|---|---|---|
| Cycles | 1000 | 1000 | 1000 | 1000 |
| Abrasion wheels | H18 | H18 | H18 | H18 |
| Additional weight | 1000 g/ wheel | 1000 g/ wheel | 1000 g/ wheel | 1000 g/ wheel |
| Weight before test in mg | 5873.8 | 5986.8 | 6166.8 | 5815.9 |
| Weight after test in mg | 5613.9 | 5729.4 | 5966.3 | 5599.2 |
| Weight loss in mg | 259.90 | 257.40 | 200.50 | 216.70 |
| Weight loss in % | 4.42 | 4.30 | 3.25 | 3.73 |
| Average weight loss in % | 4.36 | | 3.49 | |

Based on the Tables 5a-5d, it is clear that none of the tested products provides an improvement in abrasion resistance as a single component that goes beyond 50% in comparison to the raw fabric. Thus, the products as single components do not get even close to the values of the formulations according to the invention, which provide improvements in abrasion resistance according to Taber of sometimes in excess of 80% compared to the raw fabric.

The invention claimed is:

1. A process for improving the abrasion resistance of textile materials, comprising:

providing a dispersion that includes, a) 10 to 90% by weight of a wax-containing aqueous dispersion, b) 90 to 10% by weight of an aqueous polymer dispersion wherein the water content of the dispersions is respectively from 20 to 95%, and the waxes of said wax-containing aqueous dispersions have melting points of between 20-120° C., wherein said aqueous polymer dispersion is a polyurethane dispersion or polyacrylate dispersion applying the dispersion to a textile material.

2. The process according to claim 1, wherein the waxes of said wax-containing aqueous dispersions have melting points of between 20-80° C.

3. The process according to claim 1, wherein said waxes are selected from the group consisting of paraffins, silicone waxes, ester waxes, and combinations thereof.

4. The process according to claim 1, further comprising additives selected from the groups consisting of cross-linking agents, defoaming agents, processing aids, plasticizers, or other polymer dispersions.

5. The process according to claim 1, wherein the textile material is dilour nonwovens.

6. The process according to claim 1, wherein the textile material is textiles in the automotive field.

* * * * *